United States Patent [19]

Schröck

[11] Patent Number: 4,766,808

[45] Date of Patent: Aug. 30, 1988

[54] RADIAL PRESS WITH V-SHAPED PRESS JAWS

[75] Inventor: Peter Schröck, Frankfurt am Main, Fed. Rep. of Germany

[73] Assignee: Uniflex-Hydraulic GmbH, Frankfurt Main, Fed. Rep. of Germany

[21] Appl. No.: 38,906

[22] Filed: Apr. 16, 1987

[51] Int. Cl.[4] ..... B30B 1/40; B25B 27/10

[52] U.S. Cl. ..... 100/232; 100/214; 72/402; 425/330

[58] Field of Search ..... 100/214, 291, 232, 918; 425/330, DIG. 5, DIG. 129; 72/402; 29/243.56

[56] References Cited

U.S. PATENT DOCUMENTS

| | | | |
|---|---|---|---|
| 2,225,345 | 12/1940 | Lamoreaux . | |
| 2,968,837 | 1/1961 | Zeitlin et al. | 100/214 X |
| 2,999,405 | 9/1961 | Ewart . | |
| 3,271,502 | 9/1966 | Wentorf, Jr. | 100/232 |
| 3,278,993 | 10/1966 | Brayman et al. | 100/214 X |
| 3,461,710 | 8/1969 | Luedi et al. . | |
| 3,531,973 | 10/1970 | Bickley | 100/214 X |
| 4,535,689 | 8/1985 | Putkowski | 100/214 |

FOREIGN PATENT DOCUMENTS

| | | |
|---|---|---|
| 2838721 | 5/1979 | Fed. Rep. of Germany . |
| 8103456 | 12/1981 | PCT Int'l Appl. . |

*Primary Examiner*—Andrew M. Falik
*Attorney, Agent, or Firm*—Felfe & Lynch

[57] ABSTRACT

A radial press with a plurality of press jaws whose outer sides have at least two control surfaces configured at an angle to the press axis in a V-shaped arrangement. These jaws are moved in the radial direction by two control bodies, each of whose inner sides have at least one control surface cooperating with the corresponding control surfaces of the press jaws. The axial displacement of the control bodies relative to one another is performed by a drive means. The control surfaces of the press jaws and of the control bodies are planar surfaces with a slope in the direction of the axis, whose surface normals through the centroids of the surfaces intersect the axis. The control surfaces of the control bodies form the bottom surfaces of grooves whose sidewalls run parallel and are surfaces for guiding the press jaws. Between the control surfaces of the control bodies and the control surfaces of the press jaws, plates of a bearing material are inserted.

7 Claims, 7 Drawing Sheets

FIG. 4
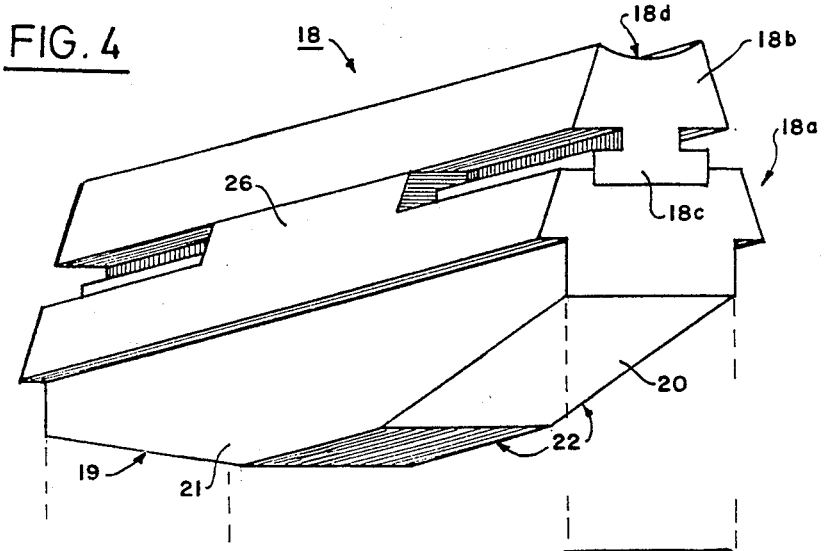
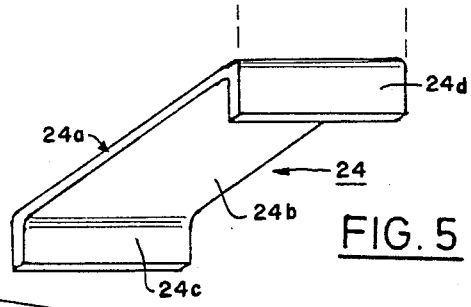
FIG. 5
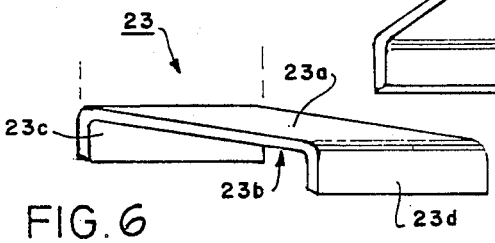
FIG. 6

35
38
37
36
34

RADIAL PRESS WITH V-SHAPED PRESS JAWS

BACKGROUND OF THE INVENTION

The invention relates to a radial press for workpieces with rotationally symmetrical outside surface, with a (a) A plurality of press jaws disposed in a circle around the axis of the workpiece outer surface, which are movable radially to this axis and whose outsides have at least two first planar controlling surfaces sloping with respect to the axis and disposed V-wise, which run between two parallel lateral guiding surfaces disposed on the press jaws, the bisector of the "V" being aligned radially and the surface normals passing through the centroids of the controlling surface intersecting the axis, (b) Control bodies whose insides each have at least one likewise planar, second controlling surface cooperating with the corresponding controlling surfaces of the press jaws, (c) A drive means producing the axial displacement of the control bodies relative to one another.

The term, "rotationally symmetrical outside surface," as used herein, is to be interpreted to mean workpiece shapes having circular cross sections and cross sections in the form of regular polygons, such as are found in hexagonal or octagonal rolled stock. The outside surfaces of the workpieces can at the same time be rectilinear in the axial direction, barrel-shaped, or stepped. Such workpiece surfaces can be accommodated by constructing the press jaws accordingly. A special field of application for which the subject matter of the invention is preferentially suited is the joining of hose fittings consisting of steel to flexible hoses, as well as the production of cable thimbles.

In a known radial press described in PCT application No. WO 81/03456, both the controlling surfaces of the press jaws and the controlling surfaces of the control bodies are conical surfaces or sectors of these conical surfaces. The controlling surfaces of the press jaws are sectors of truncoconical surfaces whose base surfaces, of equal size, are identical. Two intersecting generatrices of these conical surfaces consequently form a wide-open "V" whose bisector is precisely radial to the axis A of press and workpiece.

As a rule, one of the two control bodies is fixed, and the other control body is displaced axially by a hydraulic drive against the fixed control body. Due to the above-described configuration of all controlling surfaces, the press jaws cover exactly half of the distance in the axial direction which is covered by the moving control body. It is apparent that a precisely full-surface contact between the cooperating controlling surfaces is possible only in one very specific axial position. Above and below this point of full-surface contact, contact takes place only along a central generatrix of the controlling surface of the press jaw, or along the two farthest outside longitudinal edges of the controlling surface of the particular press jaw. This peculiarity of conical controlling surfaces brings it about that, at high press forces, such as those occurring especially in the pressing of hose fittings, extremely high surface loading occurs, and resulting frequency in the breakdown of the lubricant film, so that a stiffness or low efficiency of the press is the result. Consequently, due to the response of an overload protection (pressure relief valve in the hydraulic drive), the operation of the press comes to a halt before the pressing operation has reliably been completed. Later this can endanger personnel, considering that hydraulic hoses with their fittings can be subjected to internal pressures of 1000 bars and more.

To forestall excessive wear due to the extreme line-of-contact pressures, the motion controlling surfaces are, as a rule, hardened. This requires either the use of materials that can be hardened on-site, or the use of materials which can be case-hardened by a so-called "pack hardening" process through diffusion into the surface at high temperatures. This heat treatment, which is necessary in any case, regularly results in a distortion of the workpieces, which has to be minimized by complex design measures, and the distortion, which can not be entirely avoided, must be compensated by grinding to dimension. Such materials, and their manufacturing and processing, are expensive and complicated, and even so they do not bring the desired success in every case.

Also, on account of the transition from line contact to surface contact to line contact, instabilities occur in the pressing process between the cooperating motion controlling surfaces. On the one hand when the press jaws make contact along their center lines they tend to rock about these lines so that the pressing results on the finished workpiece are not always precisely the same, and on the other hand the sliding of the press jaws on the motion control bodies is not uniform at both ends of the press jaws, so that the longitudinal axes of the press jaws are not always precisely parallel to the press axis.

The above-described instabilities can still be overcome to some extent as long as pressing at low pressing forces and/or small workpiece diameters is involved, as is the case in crimping operations in which a sheet metal fitting is pressed onto a low-pressure hydraulic hose with the formation of serrations. At high press pressures, therefore, the initially described, double-sided pressing jaws have, as a rule, been avoided, and instead pressing jaws that act unilaterally have been used, which are operated by a single motion control body and are supported for radial displacement on the face end of an anvil on which they are mounted for radial movement, with the aid in some cases of dovetail guides.

If the radial dovetail guides are not used, and conical motion controlling surfaces are used, the disadvantage is encountered that the press jaws have the tendency to distribute themselves irregularly on the circumference of the workpiece, so that the so-called "pressing center," i.e., the sum of the vectors of all individual forces no longer coincides with the press axis. This too leads to irregular results. The return springs usually used for spreading the press jaws apart cannot, in any case, prevent the unequal distribution of the press jaws.

Furthermore the useful stroke, in the case of press jaws operated by a motion control body, is shorter, because the press jaws are given a tilting stress by the shifting attack of the motion control body, so that a relatively great overlapping of the motion controlling surfaces is necessary.

To the extent that multilaterally operating presses are disclosed by U.S. Pat. No. 4,535,689 (FIGS. 18 and 19), the planar motion controlling surfaces of the press jaws are formed by the surfaces of wedge-shaped bodies which engage one another alternately from opposite directions and are guided in face-end plates of a press frame. Due to the alternate engagement of the wedges a considerable amount of motion control area is lost, i.e., the press jaws are supported by the wedges on no more than half of their outer surfaces, so that, at a given pressing force, at least twice the pressure per unit area occurs. The guidance in the press frame is only indirect, in a kind of overhung mounting, so that the lateral guidance is but slight in spite of the enormous amount of space required by the arrangement. The axis-parallel contact surfaces for the wedges provide the press jaws in any case with no kind of lateral or transverse guidance. In the given manner of construction it is not possible to arrange more than four pairs of motion control wedges or more than four press jaws around the workpiece. Lastly, maintenance is also problematical, since the lubrication points are very much concealed, so that the press has to be at least partially disassembled for lubricating purposes.

The invention is therefore addressed to the object of improving a radial press of the kind described above such that its efficiency will be increased, that it will permit uniform pressures all the way to the end of the press action, and that both the manufacturing and the maintenance costs will be reduced accordingly.

SUMMARY OF THE INVENTION

The achievement of the described object is accomplished according to the invention, in the radial press described above, by the fact that:

(d) The second motion controlling surfaces are disposed in two motion control bodies constructed as plates, (e) The motion control bodies are each provided with grooves corresponding to the number of press jaws whose sidewalls run parallel and are guiding surfaces for the press jaws and whose groove bottom forming the particular motion controlling surface is flat and has the same slope in the axial direction as the corresponding motion controlling surface of the press jaw, (f) The motion controlling surfaces cooperating in pairs are configured and arranged in mirror-image symmetry with respect to a radial plane lying between the motion control bodies, and (g) Between the motion controlling surfaces of the motion control bodies and the motion controlling surfaces of the press jaws plates of a bearing material are inserted whose bearing portion is defined by plane-parallel surfaces.

By the above-named features it is brought about that, at the end of each press stroke, the entire area of the motion controlling surfaces of the press jaws is utilized, so that the press jaws are completely supported. The press jaws in this case are guided perfectly in the motion control bodies, i.e., in their grooves, the base of which forms the motion controlling surface. This direct guidance of the jaws in the transverse direction, however, serves not only for the guidance of the jaws but also for the reliable holding of the plates made of a bearing material. The guidance, and the transfer of the very high pressing forces is consequently possible within a very small space, so that more than four press jaws can be distributed around the circumference of the workpiece. This greatly improves the distribution of the pressing forces. It is to be noted in this case that the flow of the workpiece that takes place in the pressing operation is greatly dependent upon a uniform distribution of the pressing forces.

The bearing plates simply laid in the grooves of the motion control bodies eliminate all lubrication problems. If these bearing plates should wear out, it is very simple to replace them with new bearing plates. On the other parts of the press there is no appreciable wear, and cheaper, unhardened materials can be used, so that distortion due to hardening is eliminated. The lower pressure per unit area relative to the conditions according to U.S. Pat. No. 4,535,689 leads also to another advantage, namely to the possibility of giving the motion controlling surfaces a greater angle of attack in relation to the press axis. The greater this angle of attack is, the greater will be the radial stroke of the press jaws upon the relative axial movement of the motion control bodies. The greater this radial stroke is, the greater can be the bulk of parts which are inserted into the press, e.g., fittings of complicated shape, elbows, or the like.

In comparison to presses with conical motion controlling surfaces the advantages are retained that transitions from surface contact to line contact, press jaw canting, varying stresses per unit area and high friction losses are avoided and a very uniform flow-pressing is made possible. Breakdown of the lubricant film can no longer occur. Thus the driving forces are also reduced, so that smaller and lighter, transportable presses can be made. Nevertheless, each pressing operation is reliably carried out to the end.

It is especially advantageous if the motion controlling surfaces cooperating in pairs are arranged in mirror-image symmetry with respect to a radial plane situated between the motion control bodies. Thus it will be possible, in spite of a great radial jaw stroke length, to achieve a press of short axial overall length. This advantage is important especially in conjunction with the hose presses described above, because in these presses, either on account of the complicated shape of the fittings and/or on account of the need to press fittings onto individual sections of hose so as to form continuous lengths, a great amount of free space in both the radial and the axial direction is required in back of the press. The shorter the press is, the greater is its usefulness.

At the same time it is again advantageous for the insert plates to be made of a bearing material with self-lubricating properties. Such a bearing material is marketed under the name, "KS-DU", in the form of laminated plates or strips, for example under license from the firm of Glacier Metal Company Limited, Great Britain. Such friction bearing plates have an extremely low friction coefficient of 0.02. Thus the friction losses amount to no more than about 5% as compared with 30% in conventional designs, so that the driving forces can be lower without reducing the closing force of the press tool. A hose press equipped with such bearing plates is virtually maintenance-free, since the self-lubricating bearing material eliminates the need to relubricate the highly stressed surfaces.

It is especially advantageous, again, for the plates consisting of bearing material to have tabs bent down at both ends of the bearing portion so as to overlap the radial face ends of the motion control bodies. Such plates can then simply be laid in the press between the controlling surfaces. Then the only other thing that might be done would be to put screws through the tabs.

The construction of the radial press according to the invention makes it possible to increase considerably, in comparison to conventional designs, the angle of the controlling surfaces with respect to the press axis, from about 10 degrees to more than 20 degrees, for example. Even a controlling surface angle of 26.5 degrees has proven practicable in one example. For a given axial displacement of the control bodies relative to one another, such a steep angle results in a correspondingly greater radial stroke of the press jaws, and this in turn makes it possible to insert workpieces of more complex configuration, such as elbowed fittings for example. For this purpose a correspondingly greater no-load stroke beginning from the radially outermost end of the press jaw motion is necessary. To accomplish this, radial presses have been created in the state of the art which have composite controlling surfaces of varying pitch, and which are very expensive to manufacture. This expense can be avoided by the subject matter of the invention.

BRIEF DESCRIPTION OF THE DRAWINGS

Additional advantageous developments of the subject matter of the invention will appear from the following description of an embodiment, in conjunction with FIGS. 1 to 7, wherein:

FIG. 4 is a perspective view of a single press jaw, FIGS. 5 and 6 are perspective views of the two plates of bearing material belonging to a press jaw.

DETAILED DESCRIPTION OF THE PREFERRED EMBODIMENT

Figure 1:
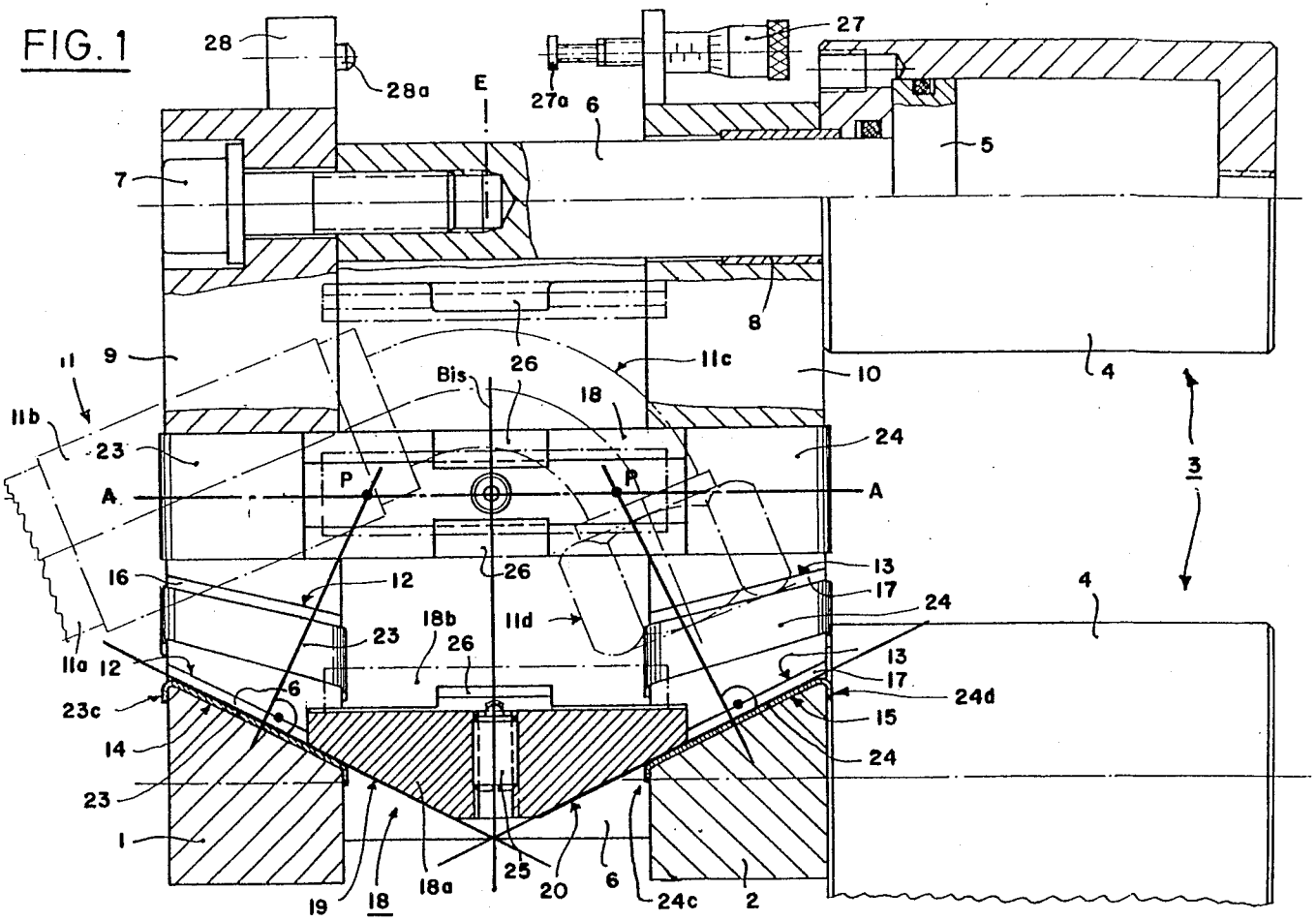
FIG. 1 shows a partially offset vertical section through the radial press (taken along line I—I) in FIG. 3, with the press jaws fully opened.
Figure 2:
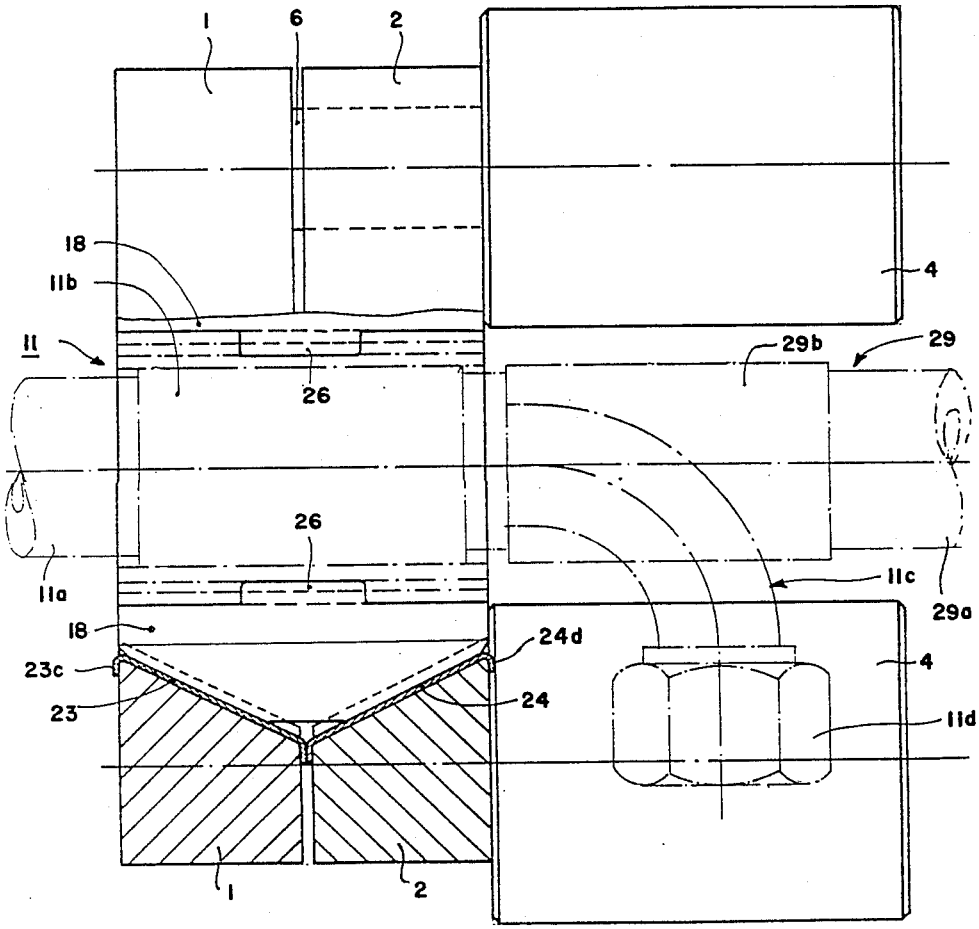
FIG. 2 is a partial vertical section through the radial press with the press jaws fully closed.
Figure 3:
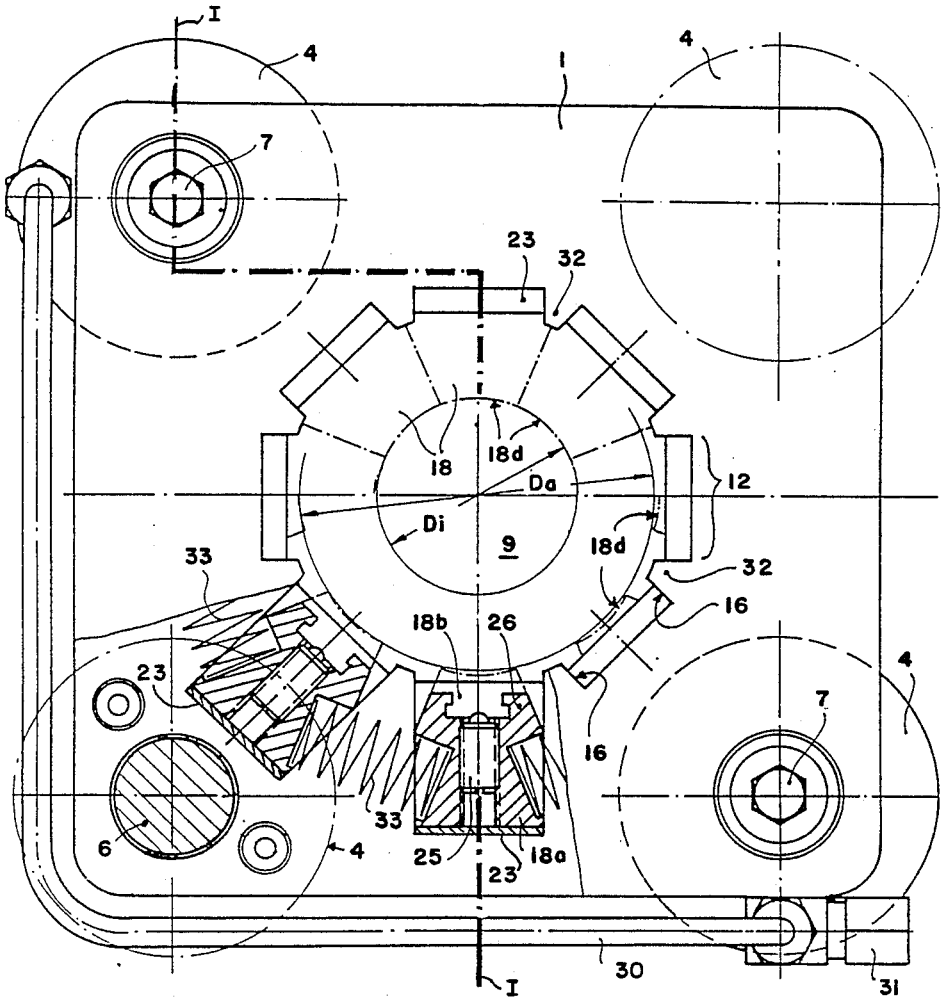
FIG. 3 is a top view, partially in section, of the end face of the radial press (seen from the left in FIG. 1)

In FIGS. 1 to 3 there are represented a stationary control body 1 and a movable control body 2 which is displaceable against the control body 1 by the action of a hydraulic drive means 3. The hydraulic drive means 3 consists of two or four hydraulic cylinders which thrust against the control body 2, and of pistons 5 and piston rods 6 which simultaneously serve as tension rods and are affixed to the control body 1 by screws 7. As a hydraulic fluid is pumped into the hydraulic cylinder 4 on the left of piston 5, the control body 2 is displaced leftward with a speed corresponding to the pumping power (i.e. pumped hydraulic fluid per unit of time of the hydraulic unit (not shown), until the end position is reached in which the control bodies 1 and 2 have the closest possible distance from each other.

A hydraulic drive of the kind described above, and its advantages, are explained in DE-OS 35 12 241 of the same applicant and corresponding to U.S. patent application Ser. No. 070,165 filed on July 1, 1987 based on U.S. Ser. No. 841,935 filed on Mar. 20, 1986 now abandoned, the application herein incorporated by reference. However, in the present case it is also possible to use a central piston drive in conjunction with additional tension rods.

The piston rods 6 are guiding elements which pass through the movable control body 2, which is provided with bushes 8 at the opening through which they pass. With the exception of the points of contact with the piston rods 6, the control bodies 1 and 2 are of a mirror-image configuration in relation to a radial plane of symmetry E—E lying between them, including the controlling surfaces which are to be further described below.

The control bodies 1 and 2, which are in the form of plane-parallel plates of square profile, each have a passage opening 9 and 10, respectively, whose envelope surface is in each case in the form of a truncated cone, while the larger base surfaces of the truncated cones face the plane of symmetry E—E. The openings 9 and 10 serve to accommodate a workpiece 11 which consists of a hose 11*a* and a sleeve 11*b* which is to be pressed thereon, and which is part of a hose fitting with an elbow 11*c* and a connecting nut 11*d*. It can be seen that the workpiece 11 is of relatively awkward shape, so that it requires the press jaws, which are to be further described below, to be able to open very wide to permit the workpiece to be inserted into the press.

Grooves 12 and 13 are machined into the control bodies 1 and 2 at equal distances around the circumference of the openings 9 and 10, respectively, and their bottoms form controlling surfaces 14 and 15, respectively. These controlling surfaces 14 and 15 are flat and have a defined slope of, for example, 26.5 degrees with reference to the axis A—A. The surface normals N passing through the centroids C of the controlling surfaces 14 and 15 all intersect the said axis A—A.

The grooves 12 and 13 have sidewalls 16 and 17 which run parallel to each groove and constitute surfaces for the guidance of press jaws 18, part of which has been omitted from FIG. 1 for the sake of clarity. Each of the press jaws 18 consists of a base jaw 18*a* and a jaw facing 18*b* (the latter represented in broken lines in FIG. 1). In a mirror-image relationship to the plane of symmetry E—E, the press jaws 18 have on their outer sides 2 the controlling surfaces 19 and 20 which have the same slope in the axial direction as the controlling surfaces 14 and 15 in the control bodies 1 and 2. The controlling surfaces 19 and 20 can also be imagined as being formed by generatrices oriented V-wise which are displaced parallel to themselves in a straight line.

As it appears especially in FIG. 4, the controlling surfaces 19 and 20 extend between two parallel lateral guiding surfaces 21 and 22 of which the rear one is concealed from view. The press jaws 18 are engaged with these guiding surfaces in the grooves 12 and 13, i.e., the guiding surfaces are in contact with the sidewalls 16 and 17 of the grooves. It is not necessary for the guiding surfaces 21 and 22 to be offset step-wise from the outer surfaces of the base jaws 18*a* lying above them. Instead, a step-less transition is possible, as is represented in FIG. 2 for the lower press jaw 18 that is shown there.

Between the controlling surfaces 14 and 15 of the motion control bodies 1 and 2 and the controlling surfaces 19 and 20 of the press jaws 18 are the plates 23 and 24 which consist of a bearing material. As it appears in FIGS. 5 and 6, these plates 23 and 24 have a middle, load-bearing portion defined by the plane-parallel surfaces 23*a*/23*b* and 24*a*/24*b*, respectively. The plates 23 and 24 have end tabs 23*c* and 23*d*, and 24*c* and 24*d*, respectively, which are bent down at both ends of the bearing portion. With these tabs the plates 23 and 24 overlap the radial end faces of the motion control bodies 1 and 2, as represented in FIGS. 1 and 2.

As it also appears in FIGS. 1 and 3, the base jaws 18*a* have each a locking screw 25 in their center by which the jaw facings 18*b* are held removably. Backing for the thrust of the locking screws 25 is provided by hook-like projections 26 disposed in the middle of the press jaws, which interlock with the dovetails 18c of the jaw facings 18b (FIG. 4).

On the side opposite the dovetail 18c, the jaw facings 18b have a working surface 18d which determines the shape of the workpiece, and in the present case is formed of a sector of a cylindrical surface.

It can be seen in FIG. 1 that a micrometer screw 27 is fastened to the control body 2, and a limit switch 28 is fastened to the control body 1. As soon as the end 27a of the micrometer screw encounters a plunger pin 28a of the limit switch, the end of the forming operation is reached and the drive means 3 is shut off by the limit switch 28. Such an end position is represented in FIG. 2.

It can furthermore be seen in FIG. 2 that, instead of the pressing of a workpiece 11 with an elbow 11c, the connection of a workpiece 11 to another workpiece 29 can be made, to which belongs a hose 29a on which a sleeve 29b has already been pressed in the same manner.

In FIG. 3 it can be seen that the hydraulic drive means can consist of either two or four hydraulic cylinders which are connected together in parallel by a hydraulic line 30, and are supplied with hydraulic fluid through a connection 31. It can furthermore be seen how the grooves 12 are distributed equidistantly on the circumference of the opening 9. Between the grooves 12 are fillets 32 which are defined by the sidewalls 16 of the grooves 12. The maximum outward position of the working surfaces 18d of the press jaws 18 is indicated by a circle with the diameter Da, and the maximum inward position, which corresponds to the final diameter of the workpiece, is indicated by the circle with the diameter Di. When the position of the working surfaces 18d reaches the inside diameter Di, the press jaws 18 and their jaw facings 18b are virtually side by side with no interval between them, so that the working surfaces 18d make up a cylinder, as represented in the upper half of FIG. 3.

It can also be seen in FIG. 3 that, between directly adjacent press jaws 18, compression springs 33 are provided which thrust tangentially against the press jaws and thereby return the press jaws 18 by means of their radial component of force to their initial position represented in FIG. 1 when the control bodies 1 and 2 are shifted apart. It must be emphasized that the compression springs 33 have no effect on the position of the press jaws circumferentially, since this position is determined exclusively by the sidewalls 16 and 17 of grooves 12 and 13, respectively, in conjunction with the guiding surfaces 21 and 22 on the press jaws. This can very clearly be seen also in the bottom half of FIG. 3.

Figure 7:
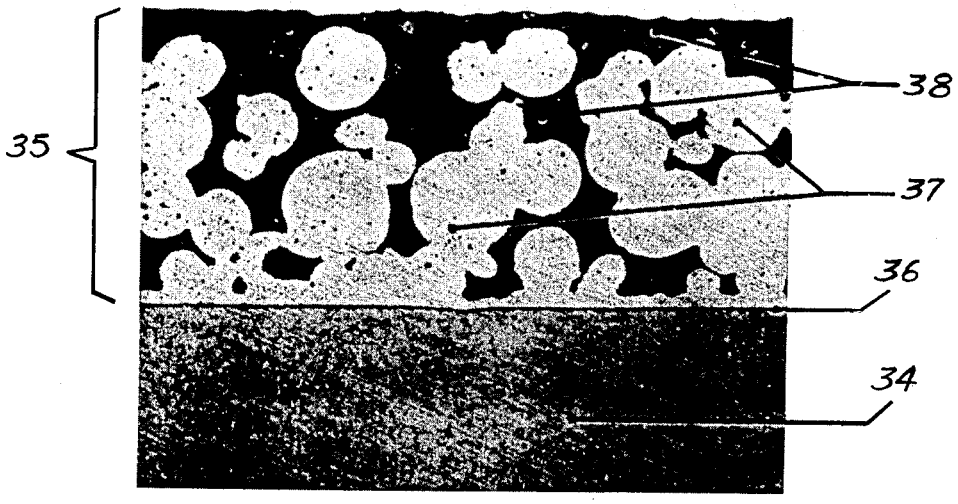
FIG. 7 is a photomicrographic cross-section through a bearing material for the plates according to FIGS. 5 and 6.

In FIG. 7 there is also shown a photomicrograph of a cross section through the plates 23 and 24 in accordance with FIGS. 5 and 6. These plates consist of a backing of sheet steel and the actual bearing material 35, the two being bonded tightly to one another by a copper layer 36. The bearing material 35 consists of an originally highly porous tin-bronze layer 37 whose interstices are filled with a solid mass of polytetrafluorethylene (PTFE) with lead particles. This bearing material has self-lubricating properties which are retained over a long period of time, and the effect whereby the lubricating properties increase with increasing surface pressure can also be observed. The common "sticking" of a radial press, which can be observed when the design surface pressure is exceeded, does not occur with this bearing material even though the design data are otherwise identical.

The bottom of the grooves 12 and 13 are always referred to above as a motion controlling surface. However, it is just as easy to consider the radially inward-facing bearing surfaces of plates 23 and 24 as controlling surfaces, inasmuch as the said surfaces are displaced radially only by the thickness of the plates 23 and 24.

Figure 8:
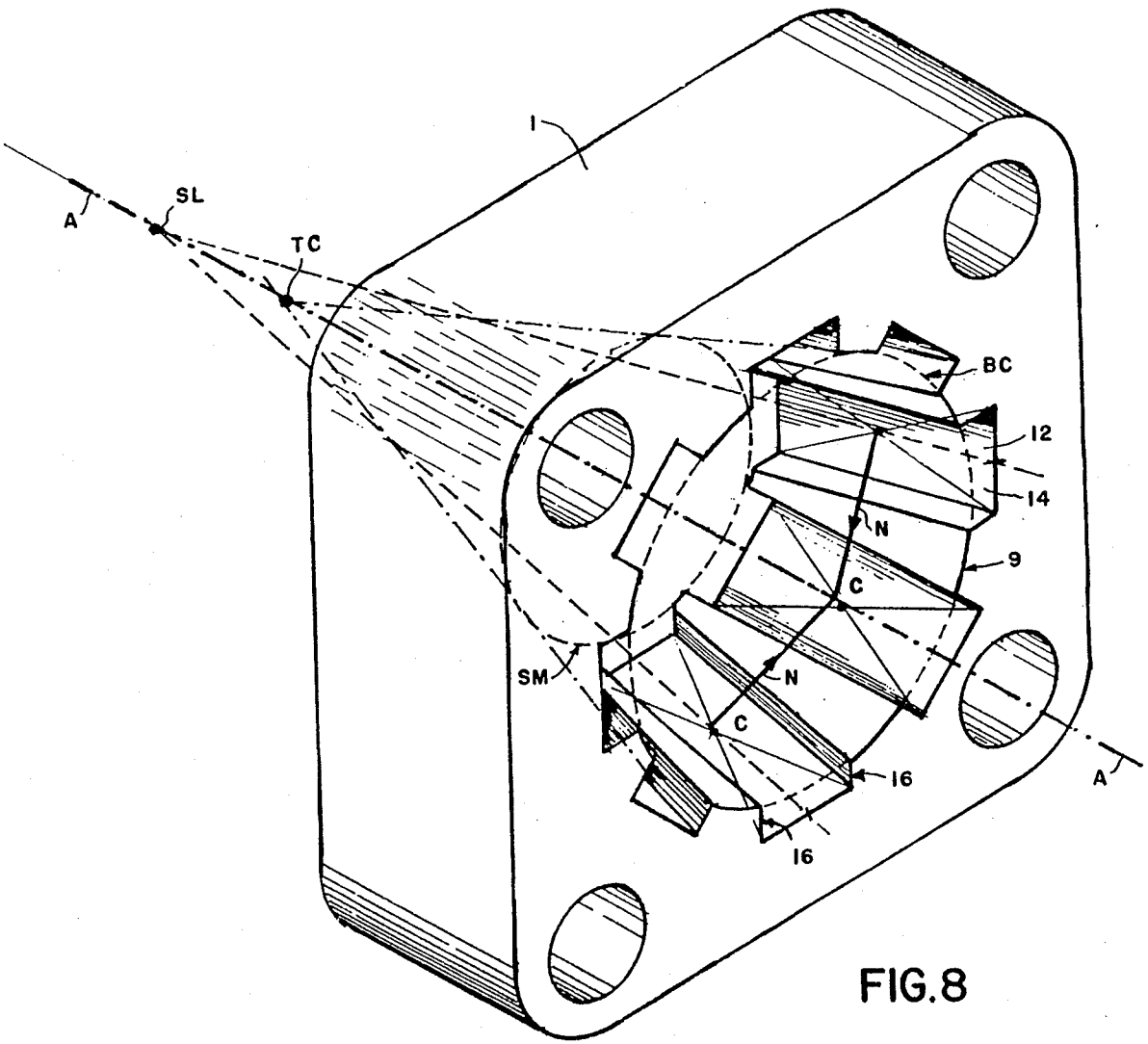
FIG. 8 is a perspective view of a control body.
Figure 9:
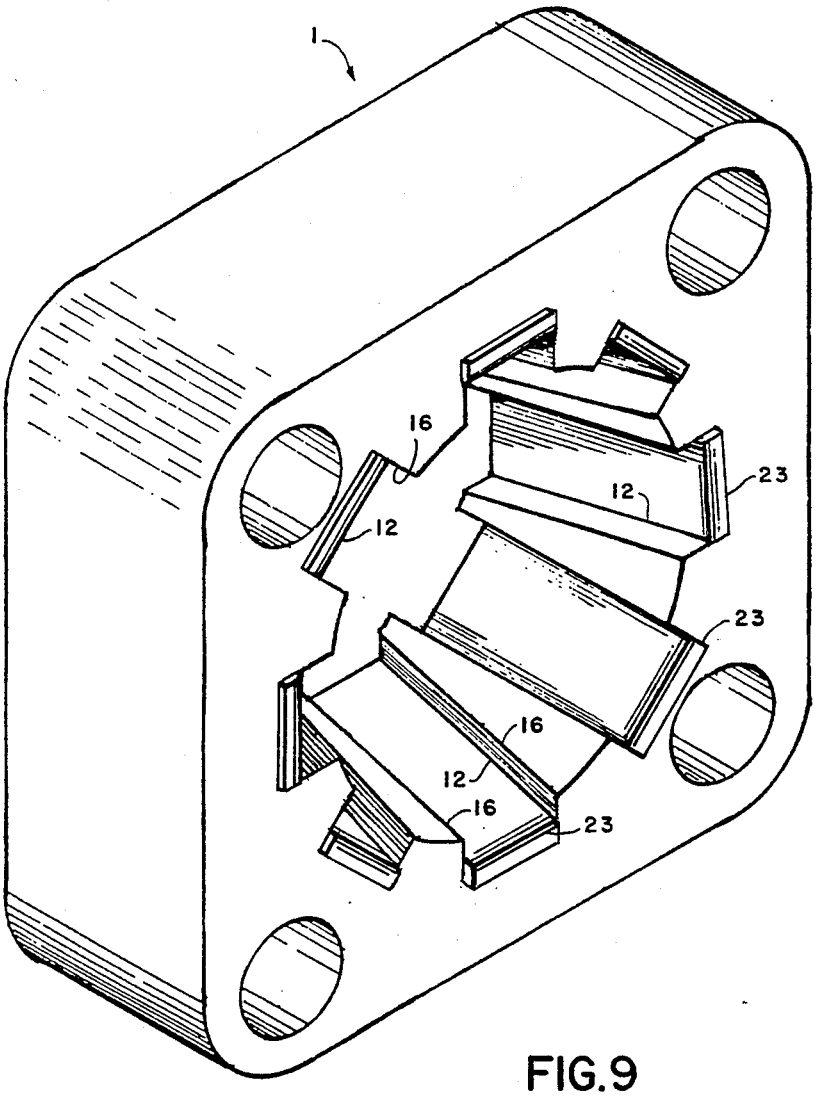
FIG. 9 is a perspective view of a control body illustrating the geometric lines of the body.

FIGS. 8 and 9 are perspective views of a control body 1 illustrating the grooves 12. Each groove 12 has parallel side walls 1b and a bottom or motion controlling surface which corresponds to and accommodates the control surfaces of the plate 23.

As shown in FIG. 8, a control body is machined from a rectangular shaped block to form a hollow truncated cone having a top TC, a smaller circle SM and a base circle BC. In the walls of the cone, grooves 12 are machined having a flat bottom which act as a cone surface for the press jaws. The grooves 12 have side walls 16 which are parallel to each other. The lines of symmetry of all the cam or controlling surfaces intersect the axis A—A at the point SL. Thus, the cam or controlling surfaces have a slope relative to the axis A—A and the normals N drawn in the centers of the cam surfaces also intersect the axis A—A at the points P. Additionally the V-shaped surfaces of the press jaws are shown in FIG. 1 to be bisected by the line BIS.

I claim:

1. A radial press having an axis extending through the radial press and accommodating a workpiece having both an axially symmetrical outer surface and an axis substantially corresponding to the axis of the radial press during the pressing operation, the radial press comprising:

(a) a plurality of press jaws disposed concentrically about the axis of the radial press and being movable in a substantially radial direction relative to the axis of the radial press, each of said press jaws having at least two planar controlling surfaces, at least two guiding surfaces, and a grooved bottom surface, said guiding surfaces disposed on lateral sides of each of the press jaws and extending in a parallel direction relative to each other, said planar controlling surfaces disposed between said guiding surfaces facing away from the workpiece and sloping away from the axis of the radial press to form V-shaped surfaces relative to each other, such that a bisecting line aligned in a radial direction relative to the axis symmetrically bisects each of said press jaws and a normal line passing through a centroid of each of said planar controlling surfaces intersects the axis of the radial press;

(b) control means disposed near said press jaws for moving said press jaws, said control means defining a plurality of grooves corresponding in number to the number of press jaws of the radial press, each groove having parallel side walls and a flat bottom surface corresponding in slope to a slope of the planar controlling surfaces of the press jaws, and accommodating a plate of a bearing material, each plate having planar, control surfaces which are defined by planar parallel surfaces facing toward the workpiece, the control surfaces cooperating with the controlling surfaces of the press jaws in mirror-image symmetry relative to a radial plane of the radial press and said grooves defined by said parallel side walls which function as guiding surfaces for the controlling surfaces of each of said press jaws; and (c) drive means for radially displacing said control means relative to the axis of the radial press.

2. The radial press according to claim 1 wherein the bearing plates comprise a self-lubricating material.

3. The radial press according to claim 1, wherein said plates further comprise tabs on two ends of the planar parallel surfaces extending downward away from the workpiece to attach the plates to the control means.

4. The radial press according to claim 1 wherein the controlling surfaces of the press jaws and the corresponding control surfaces of the control means are sloped at least 20 degrees relative to the axis of the radial press.

5. The radial press according to claim 1 wherein the control means is comprised of a cast-iron alloy.

6. The radial press according to claim 1 wherein the press jaws further comprise base jaws made of a cast-iron alloy.

7. The radial press according to claim 1 further comprising a spring means disposed between adjacent press jaws to bias apart the press jaws during the operation of the radial press.

* * * * *

UNITED STATES PATENT AND TRADEMARK OFFICE

CERTIFICATE OF CORRECTION

PATENT NO. : 4,766,808

DATED : August 30, 1988

INVENTOR(S) : Peter Schrock

It is certified that error appears in the above-identified patent and that said Letters Patent is hereby corrected as shown below:

Column 1, line 6, after "with" (first occurrence) insert --a-- and delete "a" after the second occurrence of "with".

Column 5, line 50, after "time" insert --)--.

Signed and Sealed this

Fourth Day of April, 1989

*Attest:*

*Attesting Officer*

DONALD J. QUIGG

*Commissioner of Patents and Trademarks*